US011834832B2

(12) United States Patent
Jacobsen

(10) Patent No.: US 11,834,832 B2
(45) **Date of Patent: *Dec. 5, 2023**

(54) ROOF WINDOW SYSTEM WITH A VENTILATION UNIT MOUNTED ADJACENT TO THE ROOF WINDOW, AND A METHOD OF PROVIDING VENTILATION FOR A BUILDING

(71) Applicant: VKR Holding A/S, Hørsholm (DK)

(72) Inventor: Per Jacobsen, Horsens (DK)

(73) Assignee: VKR Holding A/S

( * ) Notice: Subject to any disclaimer, the term of this patent is extended or adjusted under 35 U.S.C. 154(b) by 241 days.

This patent is subject to a terminal disclaimer.

(21) Appl. No.: 17/134,033

(22) Filed: Dec. 24, 2020

(65) Prior Publication Data

US 2021/0198894 A1 Jul. 1, 2021

(51) Int. Cl.

| | |
|---|---|
| ***E04D 13/03*** | (2006.01) |
| ***F24F 7/02*** | (2006.01) |
| ***F24F 13/28*** | (2006.01) |

(52) U.S. Cl.

CPC ..... *E04D 13/0325* (2013.01); *E04D 13/031* (2013.01); *F24F 7/025* (2013.01); *F24F 13/28* (2013.01); *F24F 2221/20* (2013.01)

(58) Field of Classification Search

CPC .... F24F 13/18; F24F 7/02; F24F 7/025; F24F 2221/20; E06B 7/02; E06B 7/10;

(Continued)

(56) References Cited

U.S. PATENT DOCUMENTS 217,630 A * 7/1879 Maull ..... E06B 7/10 454/211
614,497 A * 11/1898 Praetsch ..... E06B 7/10 454/211

(Continued)

FOREIGN PATENT DOCUMENTS

CN 101778980 A 7/2010 ..... E04D 13/03
DE 102004052936 5/2006

(Continued)

OTHER PUBLICATIONS

Machine generated translation of DE202016100906.

(Continued)

*Primary Examiner* — Kyle J. Walraed-Sullivan
(74) *Attorney, Agent, or Firm* — Merek, Blackmon & Voorhees, LLC

(57) ABSTRACT

The roof window system (1) is configured for being mounted in an opening in a roof structure (23) of a building and includes a ventilation unit (5) configured for being mounted adjacent to a roof window (13) and adapted for providing ventilation of the interior of the building in which the roof window is mounted. The roof window comprises a frame (2) defining a frame plane and including a pane (4) mounted in said frame. The frame comprises a top frame member (2*a*) intended for being located highest in the mounted state when seen in the direction of inclination of the roof structure, a bottom frame member opposite the top frame member, and two side frame members extending between the top frame member and the bottom frame member, said frame members together form a window structure delimiting a frame opening and each having an interior side (2*f*) intended for facing the interior in the mounted state, an exterior side intended for facing the exterior, an inner side (2*d*) facing the frame opening and an outer side (2*e*) facing away from the frame opening. The (Continued)

ventilation unit is configured for being arranged primarily adjacent to the outer side of a frame member, and comprises a lower side (24) configured for being arranged adjacent to or at the interior side (2*f*) of said frame member (2*a*). The roof window system further comprises a ventilation panel (3) allowing air passage from one side of the ventilation panel to another side of the ventilation panel, thereby defining an intended air flow direction, said ventilation panel being configured for facing the interior of the building and extending away from the interior side of the frame member adjacent to which the ventilation unit is mounted.

17 Claims, 4 Drawing Sheets

(58) Field of Classification Search
CPC . E06B 2007/023; E04D 13/03; E04D 13/031; E04D 13/0325
See application file for complete search history.

(56) References Cited

U.S. PATENT DOCUMENTS 1,126,875 A * 2/1915 Saunders ..... E06B 7/02 454/213
1,446,066 A * 2/1923 Pratt ..... E06B 7/10 160/91
1,643,554 A * 9/1927 Glass ..... E06B 7/10 454/222
4,338,996 A * 7/1982 Frank ..... E06B 9/17 165/122
4,570,393 A * 2/1986 Minter ..... E04D 13/0354 52/72
4,736,677 A * 4/1988 Smith ..... E06B 7/10 454/213
5,046,407 A * 9/1991 Nielsen ..... F24F 7/013 454/366
5,062,247 A * 11/1991 Dittmer ..... E04D 13/0325 52/302.1
5,544,455 A * 8/1996 DeBlock ..... E04B 9/32 52/220.8
5,581,945 A * 12/1996 Baumle ..... F24F 13/16 49/38
6,648,750 B1 * 11/2003 Wiseman ..... F24F 13/18 454/211
6,695,692 B1 * 2/2004 York ..... F24F 7/025 454/900
7,083,110 B2 * 8/2006 Kim ..... E06B 7/10 454/200
7,624,547 B1 * 12/2009 Brinton ..... E04D 13/0315 52/60
10,830,464 B1 * 11/2020 Stevenson ..... F24F 7/007
2004/0139669 A1 * 7/2004 Feucht ..... E04D 13/0315 52/204.5
2014/0230349 A1 * 8/2014 Rasmussen ..... E06B 7/2314 52/200
2017/0097168 A1 * 4/2017 Chang ..... F24F 11/30
2018/0179760 A1 * 6/2018 Humble ..... E04D 13/0325
2019/0128053 A1 * 5/2019 Patel ..... E06B 7/10
2019/0249889 A1 * 8/2019 Chan ..... E04D 13/0325
2019/0277522 A1 * 9/2019 Soyyigit ..... F24F 11/89
2020/0056424 A1 * 2/2020 Farnes ..... E06B 9/68
2020/0164384 A1 * 5/2020 Kang ..... B03C 3/82
2020/0224423 A1 * 7/2020 Jacobsen ..... E04D 13/031
2021/0010700 A1 * 1/2021 Zhang ..... F24F 13/28
2021/0198893 A1 * 7/2021 Nielsen ..... E04D 13/0325
2021/0198894 A1 * 7/2021 Jacobsen ..... F24F 13/28
2022/0145688 A1 * 5/2022 Duncan ..... E05F 1/1215

FOREIGN PATENT DOCUMENTS

DE 202016100906 8/2016
EP 2317026 11/2009
EP 2784240 1/2014
EP 2762653 8/2014
EP 2762670 8/2014
EP 2784240 A2 10/2014 ..... F24F 13/18
EP 2813632 12/2014
EP 2813632 A1 12/2014 ..... E04D 13/03
EP 3309468 4/2018
EP 3348736 7/2018
EP 3348736 A1 7/2018 ..... F24F 7/02
EP 3404191 11/2018
GB 2259540 3/1993
GB 9514670 9/1995 ..... E06B 7/10
GB 2303441 2/1997
GB 23003441 2/1997
GB 2194038 2/1998
GB 0210422 6/2002 ..... F24F 7/013
GB 2389175 3/2003
GB 2412164 9/2005
JP H0762810 3/1995
JP 2014020146 2/2014
WO WO-2008133539 A2 * 11/2008 ..... E04D 13/0325
WO WO2019015732 1/2019

OTHER PUBLICATIONS

U.S. Appl. No. 17/134,013.
Danish Search Report and Opinion dated Jun. 25, 2020 issued in Danish Application No. PA 2019 70836, eleven (11) pages.
European Search Report dated Apr. 13, 2021 issued in European Application No. EP 20216779, two (2) pages.
English translation of Chinese Office Action dated Jul. 28, 2023 issued in Chinese Application No. 202011600246.4, twelve (12) pages.

* cited by examiner

ROOF WINDOW SYSTEM WITH A VENTILATION UNIT MOUNTED ADJACENT TO THE ROOF WINDOW, AND A METHOD OF PROVIDING VENTILATION FOR A BUILDING

TECHNICAL FIELD

The present invention relates to a roof window system configured for being mounted in an opening in a roof structure of a building, said roof window system including a ventilation unit configured for being mounted adjacent to a roof window and adapted for providing ventilation of the interior of the building in which the roof window is mounted, where said roof window comprises at least one frame defining a frame plane and including a pane mounted in said frame, the frame comprising a top frame member intended for being located highest in the mounted state when seen in the direction of inclination of the roof structure, a bottom frame member opposite the top frame member, and two side frame members extending between the top frame member and the bottom frame member, said frame members together form a window structure delimiting a frame opening and each having an interior side intended for facing the interior in the mounted state, an exterior side intended for facing the exterior, an inner side facing the frame opening and an outer side facing away from the frame opening, where the ventilation unit is configured for being arranged adjacent to the outer side of a frame member.

The invention also relates to a method of providing ventilation to a building through such a roof window system.

BACKGROUND ART

Roof windows can serve different purposes on buildings. Besides facilitating the entry of natural light indoors, they may keep the building ventilated. The provision of ventilation in windows has become standard equipment nowadays. The intentional air exchange through windows is called airing. The unintentional airflow through openings of the building is called air infiltration. Ventilation itself can be divided into mechanical, or forced, and natural ventilation. In mechanical ventilation, fresh air is supplied into the room with the help of fans, ducts, inlet and outlet openings or vents. In natural ventilation, the air flow is brought through purpose provided openings, e.g. windows, like airing. There are lower investment, maintenance and operational costs associated with natural ventilation. On the other side, natural ventilation systems may not be able to keep a constant air flow rate, since they are much de-pendent on outdoor weather conditions (i.e. wind speed, wind direction, temperature differences). Overall, windows may offer different options of ventilating a room and refreshing the air indoors. This can help to improve indoor air quality and also, reach a desired indoor temperature. Moreover, ventilating through windows can be a quick, affordable and noise-less solution for the occupants.

Different solutions for enhancing the ventilation through windows have been previously developed and found in literature. Examples of roof windows and ventilation assemblies are presented in DE 20 2016 100 906 U1, EP 3 309 468 A2 and EP 3 348 736 A1. Another example is shown in EP 2 784 240 A2, which discloses a roof window system comprising a ventilation assembly being adapted to accommodate a ventilation unit or units, where air enters or exits the building via an air passage between the frame and the sash which can be closed by a so-called ventilation flap. That allows the air to enter or exit the room with a direction away from the window pane.

The above-mentioned prior art documents provide good solutions of ventilating the indoor space by utilizing the roof windows. However, their configuration is usually complicated and certain alterations to the existing window and/or roof structure may be needed. Moreover, the intervention on the exterior of the building is significant, also leading to necessary modifications of the roof structure (e.g. removal of tiles around the roof window). In some of the cases, the configuration of the ventilation assembly results in increased wind buoyancy which affects the thermal sensation of the occupants. All these reasons infer several limitations to the existing solutions of roof windows with integrated ventilation assemblies.

SUMMARY OF INVENTION

With this background, it is an object of the invention to provide a roof window system by which it is possible to improve thermal comfort and indoor air quality without compromising other parameters such as functionality, installation, use, or aesthetics.

This and further objects are achieved with a roof window system of the kind mentioned in the introduction which is furthermore characterised in that it comprises a ventilation panel allowing air passage from one side of the ventilation panel to another side of the ventilation panel, thereby defining an intended air flow direction, said ventilation panel being configured for facing the interior of the building and extending away from the interior side of the frame member adjacent to which the ventilation unit is mounted.

In a second aspect, a roof structure is provided with such a roof window system.

In a third aspect, a method of providing ventilation to a building is provided.

One non-limiting advantage that is gained by the use of the roof window system according to the invention is providing a ventilation unit that integrates well with a roof and roof window and utilizes the available space, while the installation is simple. This is achieved by the ventilation unit being placed adjacent to the outer side of the frame member, meaning that only a minimal amount of roofing material has to be removed and that the total roof window system will appear compact in the mounted state. Therefore, a flexible solution is provided that may be mounted to most roof windows, without causing any extra damage to the roof, since the existing window structure (i.e. frame members) are used to support the ventilation unit and the ventilation panel.

The ventilation panel allowing air to flow from one side of it to the other facilitates the natural ventilation and may ultimately contribute to the improvement of the indoor air quality and thermal comfort. The flexibility and ease of the window installation is ensured and the operation of the ventilation is facilitated through the ventilation panel which is facing the interior of the building and extending away from the interior side of the frame member. This means that the ventilation panel is located in continuation of the inner side of the window frame member so that the air enters close to the window and the wall or ceiling of the building is not interrupted or at least only interrupted where an opening has already been made for the window. Air entering close to the window may contribute to a better thermal sensation of the occupants of the building. Furthermore, the window frame itself does not have to be modified.

In an embodiment, the ventilation panel may be configured such that the ventilation panel is not extending below the inner window frame plane defined by the inner side of the frame member in a mounted state. In an alternative embodiment, the ventilation panel may be configured such that the ventilation panel is placed between the inner window frame plane defined by the inner side of the frame member and the outer frame plane defined by the outer side of the frame member in a mounted state. In a preferred embodiment, the ventilation panel is placed 5 mm away from the inner frame plane towards the outer direction. The ventilation panel may be placed in a distance of 6, 7, 8, 9, 10 mm from the inner frame plane towards the outer direction. The positioning of the ventilation panel such that it does not extend below the inner frame plane facilitates the invisibility of the ventilation panel from indoors.

The inner frame plane and the outer frame plane define the thickness of the frame member. The ventilation panel may be configured such that the thickness of it does not exceed ⅓ of the total thickness of the frame member.

In one embodiment of the invention, the ventilation panel may be configured such that the intended air flow direction may extend substantially perpendicular to the frame plane in the mounted state. This allows for an effective exchange of air between an interior space covered by the roof structure and an exterior surrounding the building, the air flow direction being substantially parallel to the frame plane and hence to the pane of the window. This may contribute to reducing the formation of condensation on or at the pane.

The ventilation unit may be configured to be connected to or adjacent to a frame member. This may allow the ventilation unit to be mounted to any roof window, without causing severe damage to the roof, thus consisting a flexible solution. Moreover, the window and the ventilation unit may potentially be handled as one unit during installation.

The ventilation unit may be mounted by connecting means to the window frame or by connecting bracket means to the roof structure.

The ventilation unit may be configured to be arranged at the top frame member, which is an optimal position from a ventilation point of view, but could also be at the bottom or at the sides of the window. In addition, other types of accessories such as shades, shutter, blind, rain sensors etc. are typically mounted at the top of roof windows and by positioning the ventilation unit here means that one housing can be used for one or more different accessories.

The ventilation unit may preferably comprise a cover side configured for being arranged adjacent to or at the interior side of said frame member.

The ventilation panel may be configured for being accommodated in a groove in the frame adapted for receiving a lining panel and/or provide a groove configured to accommodate a lining panel. This makes the ventilation panel easy to install and provides a robust and visually appealing joint between the ventilation panel and the frame and/or lining panel. The ventilation panel may extend between the interior side of the roof window frame and the lining panel covering at least a part of a surface of the roof structure defining the roof opening in the mounted state, thus replacing and/or being integrated into the innermost part of a prior art lining panel closest to the window frame.

The roof window system may further comprise a lining panel, according to which the ventilation panel is integrated in the lining panel. The ventilation panel may be mounted into the top part of the lining panel. In this case, this will make the ventilation panel not visible from an average eye-level height indoors and eliminating a step in the mounting process since the ventilation panel will automatically come into place when mounting the lining panel.

The ventilation panel may comprise a grating and/or a closure, for safety reasons.

The roof window system may comprise a ventilation assembly that comprises the ventilation unit and a housing to accommodate the ventilation unit.

The housing may comprise a solar cell mounted on the exterior side of the housing to supply the ventilation unit with electricity. This solution can lead to significant energy savings with regards to the power that is needed to run the ventilation unit, a driving motor inside the ventilation assembly or a ventilator. The maximum area that the solar cells can cover, thus, are given by the exterior surface of the housing. For example, an area of 0.28 $m^2$ should be adequate to supply electricity to the ventilation unit so that it provides ventilation of 170 $m^3$/hour to a building.

The roof window system may further comprise a sash, comprising a top member, bottom member and two side members defining a sash plane. The ventilation unit may be configured for being mounted such that the ventilating unit, the frame member adjacent to which the ventilation unit is mounted and the corresponding sash member are located substantially in continuation of each other when seen in the direction of the frame plane in the mounted state. The housing being in the plane of the frame makes it possible to provide a ventilation assembly which is inconspicuous and easy to install, as the same aperture in the roof may be utilized, for instance simply by removing one or more rows of tile above the window. No penetration of the underlying vapour barrier collar is necessary, just as the provision of cover members is made easy. Consequently, flashing members fitting the roof window may be provided, just with an extra length as compared to the flashing fitting the window itself to accommodate the housing of the ventilation unit, as well.

The dimensions of the housing may be chosen such that the length of the housing is parallel to the length of the frame member which the ventilation unit is adjacent to, and does not exceed the length of the frame member, and the height of the housing is parallel to the height of the frame member which the ventilation unit is adjacent to, and does not exceed the height of the frame member. This provides ease of installation since the aperture in the roof may be utilized without making extreme alterations to the roof structure and means that the ventilation assembly does not stand out from the roof window thus making the roof window system inconspicuous in the mounted state. In order to make the underroof water tight, the roof membrane may need to be penetrated and the commonly used underfelt collar may be ex-tended to also cover the housing. This may require that the underfelt collar has a necessary size to cover the whole roof window system.

It may be advantageous to choose the dimensions of the housing, such that the length of the housing is parallel to the length of the frame member which the ventilation unit is adjacent to, and is smaller than the length of the frame member, and the height of the housing is parallel to the height of the frame member which the ventilation unit is adjacent to, and is smaller than the height of the frame member. This may reduce the manufacturing costs and result in less bulky housing that is easier to mount.

In relation to the frame member which the ventilation unit is adjacent to, a length dimension may be defined as a dimension substantially in parallel with a respective top or bottom peripheral side of the pane in the mounted state, a height dimension may be defined as a direction perpendicular to the length dimension, and a width dimension may be defined as a dimension perpendicular to the height and length dimensions.

The roof window system may be mounted in an inclined roof structure. Inclined roof windows are typically built into an opening in an inclined roof structure with an angle above 15 degrees with a substantial part of the inclined roof window being positioned within the inclined roof structure in an installed position. Thus, roof windows for inclined roofs are typically built into the roof structure. This means that the frame and sash, e.g. most of the frame and sash structures, are embedded in the roof so that much, most or all of an outer surface of the frame facing away from the opening in the frame is positioned within the roof structure.

The ventilation panel may further comprise a ventilation duct for covering and protecting the ventilation panel and directing the air towards the ventilation passage and to the interior of the building. The ventilation duct may comprise a permeable fabric (e.g. polyester).

The ventilation unit may be configured for installation in a sloping roof with inclination from 20 to 70 degrees, preferably 30 to 60 degrees.

The ventilation unit may further comprise a hinge at the exterior outer side of the housing, such that the opening and/or closing of the top case of the housing is enabled.

The ventilation assembly may comprise an input and exhaust of air and/or a ventilator and/or an air purifying filter. The ventilator may be pivotally journaled in housing of the ventilation assembly to switch the flow direction. A regenerator or a heat exchange device may also be comprised in the ventilation assembly. Other elements that may be comprised into the housing may be found in the application EP 2 784 240 A2.

The drainage channel may be configured to form a positive angle of at least 5 degrees with reference to the plane of the window.

The insulation of the interior of the building may be adjusted to accommodate for the installation of the ventilation panel. The ventilation panel may be placed near the window pane and/or near the bottom side of the lining panel.

In an embodiment of the invention, a manifold may be pressed into a spacing between the frame and the underfelt collar, such that there is no need to penetrate the underfelt collar.

The roof structure may include the roof window system, including the ventilation unit.

The method according to the invention comprises the steps of:

arranging the ventilation unit adjacent to the outer side of a frame member, said ventilation unit being adapted for providing ventilation of the interior of the building, arranging a ventilation panel so that it faces the interior of the building and extends away from the interior side of the frame member adjacent to which the ventilation unit is mounted, and passing air through a ventilation panel from one side of the ventilation panel to another side of the ventilation panel in an intended air flow direction using the ventilation unit. This method may comprise the steps of providing the housing with activation means, connecting the ventilation unit or units to the housing and activating the housing by operating the ventilation unit. Activation means may be a closure that is handled manually, a ventilation flap etc. The closure may be temporary locked between an open and a closed position. According to this, the operation of the ventilation unit is facilitated. Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise.

Embodiments and advantages described with reference to one aspect of the invention also applies to the other aspect(s) unless otherwise stated.

BRIEF DESCRIPTION OF DRAWINGS

The invention will be described in more detail below by means of non-limiting examples of embodiments and with reference to the schematic drawings, in which.

DESCRIPTION OF EMBODIMENTS

Referring to FIGS. 1, 2, 3 and 4 showing the overall appearance and principles underlying a roof window system in an embodiment of the invention, the roof window system comprises a roof window 13, a ventilation unit 5 and a ventilation panel 3.

Figure 1:
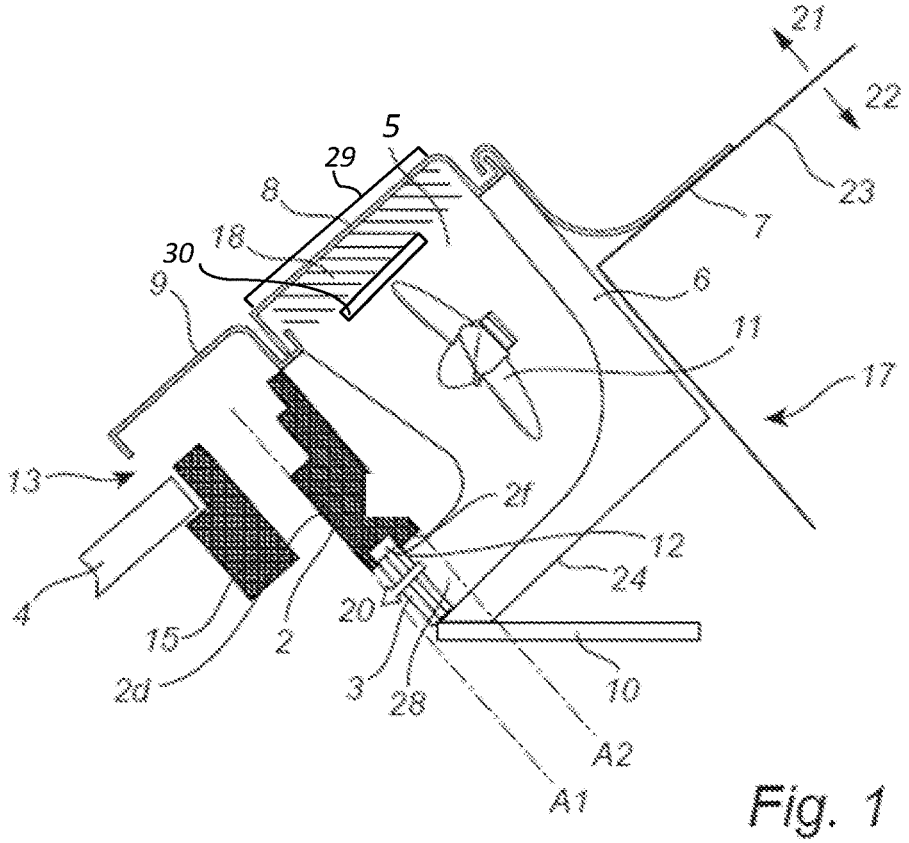
FIG. 1 is a cross-section view of a roof window system in an embodiment.

As shown in FIG. 1, the roof window system 1 comprises a ventilation unit 5 mounted adjacent to the frame 2 of the roof window 13, which also includes a sash 15 and a pane 4. The frame 2 is adapted to be built into a roof structure 23 of virtually any kind, typically comprising a number of rafters, battens, and further non-shown details such as vapour barrier collars etc., below a roofing material. The ventilation unit 5 is arranged adjacent to the outer side 2*e* of the frame member adjacent to which the ventilation unit is placed adjacent to, i.e. in this case the top frame member 2*a*. The ventilation panel 3 allows air to pass from one side of the ventilation panel to the other, defining an intended air flow direction 20. The intended flow direction 20 that is allowed by the ventilation panel 3 extends substantially perpendicular to the frame plane in the mounted state of the roof window 13. The ventilation panel 3 is positioned, facing the interior 14 of the building, and extends away from the interior side 2*f* of the frame member.

The frame (and/or the sash) of the window may be made of wooden members or members made of cast or extruded polyurethane (PUR). In the mounted state, the frame 2 and the sash 15 are protected by cover elements including a top frame covering 9 and a flashing arrangement 7, which are here interconnected by the top case 8 of the housing of the ventilation assembly 17. Towards the interior, a lining panel 10 is provided as a suitable finishing. In FIG. 1 the ventilation panel 3 is arranged in continuation of the lining panel 10 and engaging a groove 12 in the interior side 2*f* of the frame member normally used for receiving the lining panel, and in FIG. 3 the ventilation panel 3 is integrated into the lining panel. The lower side of the ventilation unit 24 is positioned closest to the lining panel 10.

In relation to the roof window system, an exterior direction 21 is defined as facing towards the surrounding of the building, an interior direction 22 is the opposite direction of the exterior facing towards the interior 14 of the building. An inner direction is defined as facing towards the frame opening 16, while an outer direction is the opposite of the inner one. An inner frame plane A1 is defined by the inner side of the frame member, while an outer frame plane A2 is defined by the outer side of the frame member.

Figure 2:
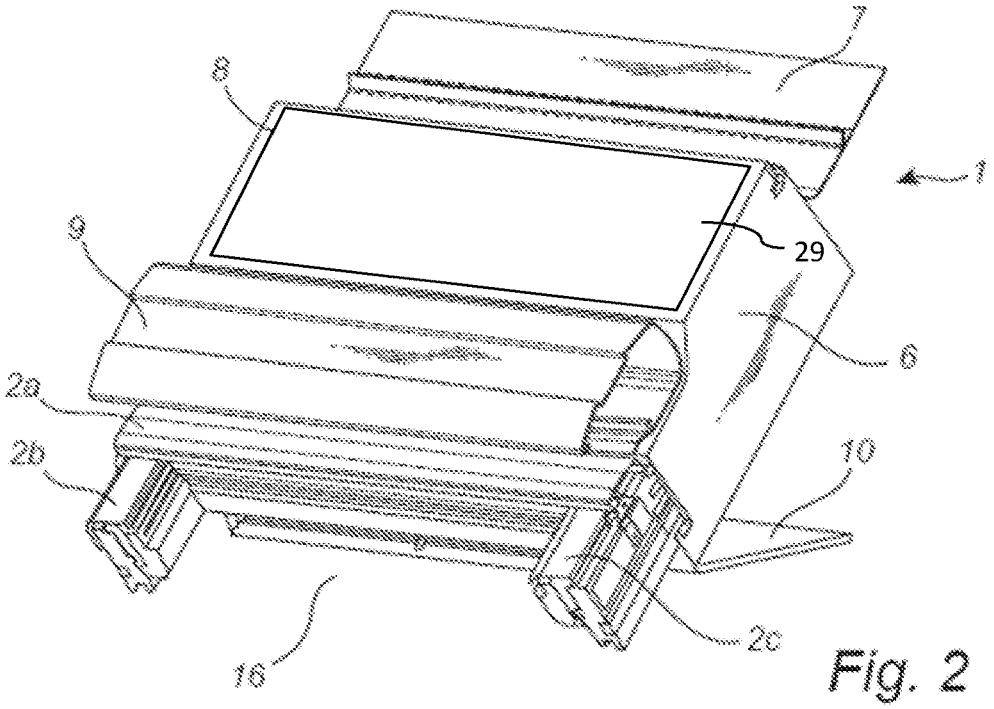
FIG. 2 is a perspective view of an embodiment of a mounted roof window system.

As illustrated in FIG. 2, the frame comprises a top frame member 2*a* which is located highest in the mounted state as seen in the direction of inclination of the roof structure, a bottom frame member (not shown here) opposite the top frame member, and two side frame members 2*b*, 2*c*, extending between the top frame member 2*a* and the bottom frame member. The frame members together delimit a frame opening 16. Each of them has an interior side 2*f* facing the interior in the mounted state, an exterior side facing the exterior, an inner side facing the frame opening and an outer side 2*e* facing away from the frame opening 16.

The ventilation assembly 17 comprises the ventilation unit 5 and the housing 6. The ventilation unit 5 may be adapted to be connected to the ventilation assembly 17 of the roof window 13 so as to provide an air connection between the interior of the building 14 and the exterior, in the mounted state. The housing 6 accommodates the ventilation unit 5 and is placed adjacent to the top frame member 2*a*. In this embodiment, the ventilation assembly further comprises a ventilator 11 and an exterior air grating 18 as seen in FIG. 1. In the ventilation assembly 17, an air purification filter, shown by a rectangular box 30 in FIG. 1 may be also comprised. A groove 12 is provided in the frame member. The housing 6 is generally designed as having a top case or cover 8, a bottom part and/or (an) end piece(s). In this embodiment, solar cells, shown by a rectangular box 29 in FIGS. 1 and 2, are placed on the exterior surface of the housing, which is denoted by the top case of the housing 8.

Figure 3:
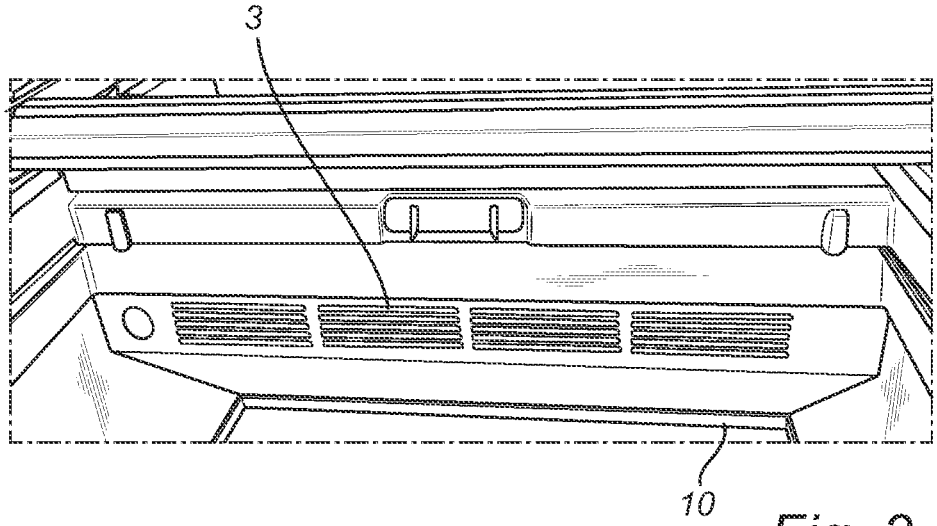
FIG. 3 is a bottom view of a roof window system including the ventilation panel in another embodiment.

FIG. 3 shows details of an embodiment of the roof window system 1 including the ventilation panel 3. Here too, the ventilation panel extends away from the interior side of the frame member and is in continuation with the lining panel 10.

Figure 4:
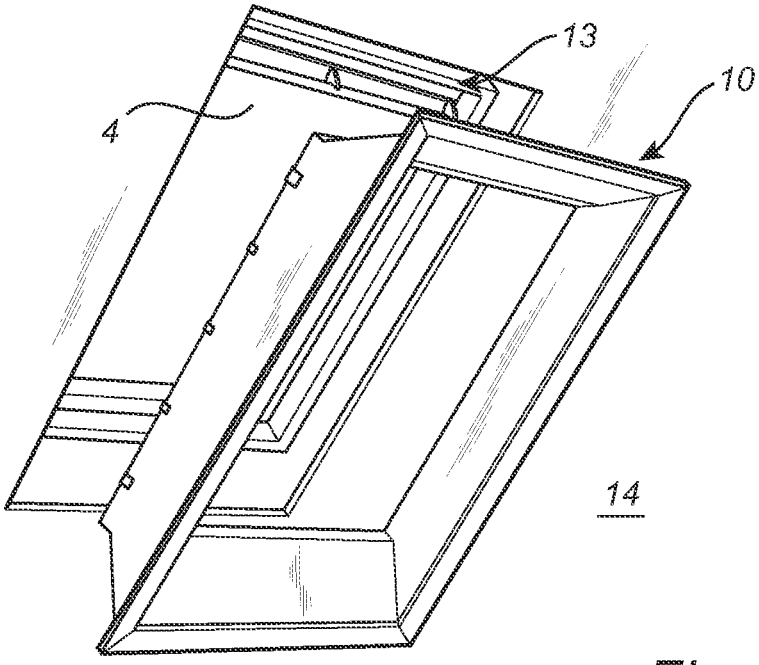
FIG. 4 is a perspective view of a roof window system in an alternative embodiment.

FIG. 4 shows a perspective view of the roof window 13 during installation of the lining panel 10 on the interior side of the building 14.

Figure 5:
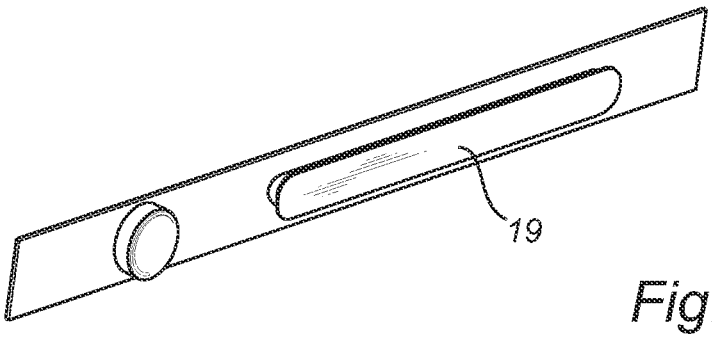
FIG. 5 is a perspective view of the details of an embodiment of the ventilation panel.

FIG. 5 shows an alternative embodiment of an air grating 19 of the ventilation panel for an inclined roof window system. The air grating 19 provides a closure for the ventilation panel 3. The air grating 19 may be temporary locked between a closed and an open position.

Figure 6A:
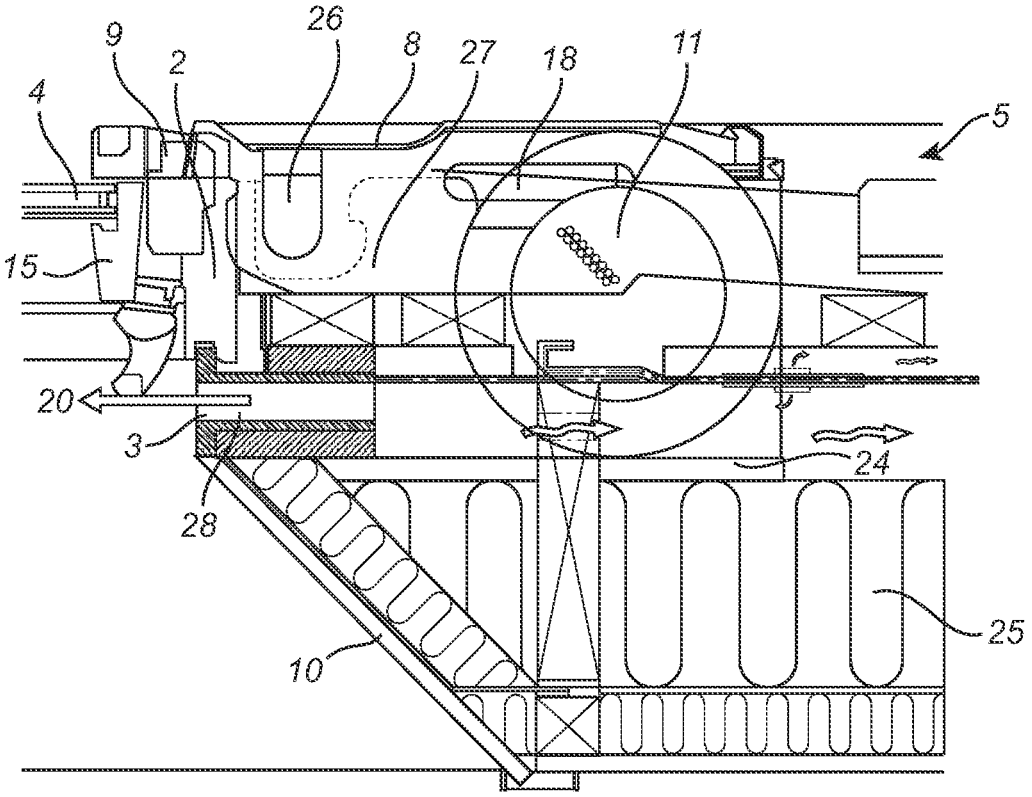
FIG. 6*a* is a sectional view of an embodiment of the ventilation unit mounted on a roof window system.
Figure 6B:
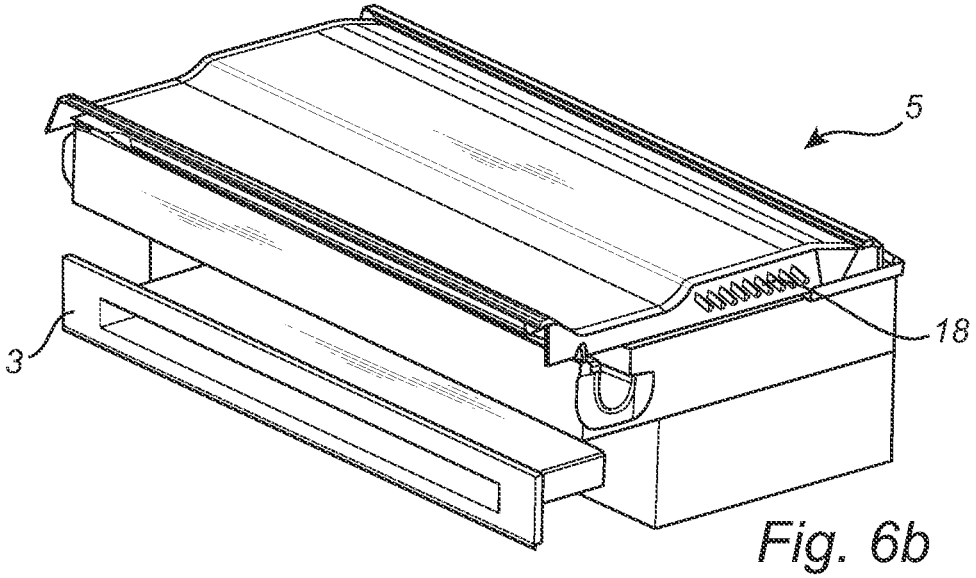
FIG. 6*b* is a schematic perspective view of a ventilation unit of a roof window system in an embodiment according to the invention.

FIG. 6*a* shows a cross-sectional view of an embodiment of the roof window system. FIG. 6*b* is included to provide a better overview of the components, in particular the ventilation panel 3 and the exterior grating 18. The longitudinal channel 26 is mounted onto the window frame 2, in parallel to the longitudinal edge of the top frame member. The housing 6 comprises a drainage channel 27 extending from the longitudinal channel to the ventilator 11, forming a positive angle with a bottom side of the longitudinal channel, such that rainwater is drained out to the roof. In FIG. 6*a*, it is shown how the ventilation panel 3 is integrated into the lining panel 10 near the window pane 4. The ventilation panel 3 could also be in continuation with the lining panel 10. The lower side of the ventilation unit 24 is positioned closest to the lining panel 10. The insulation 25 is adjusted at the top end so that the ventilation panel is placed near the window pane 4. When the roof window system is mounted, the exterior air grating 18 is placed such that it is higher than the plane of the roof window, so that rainwater does not enter into the exterior air grating 18 and into the ventilation unit 5.

Figure 7A:
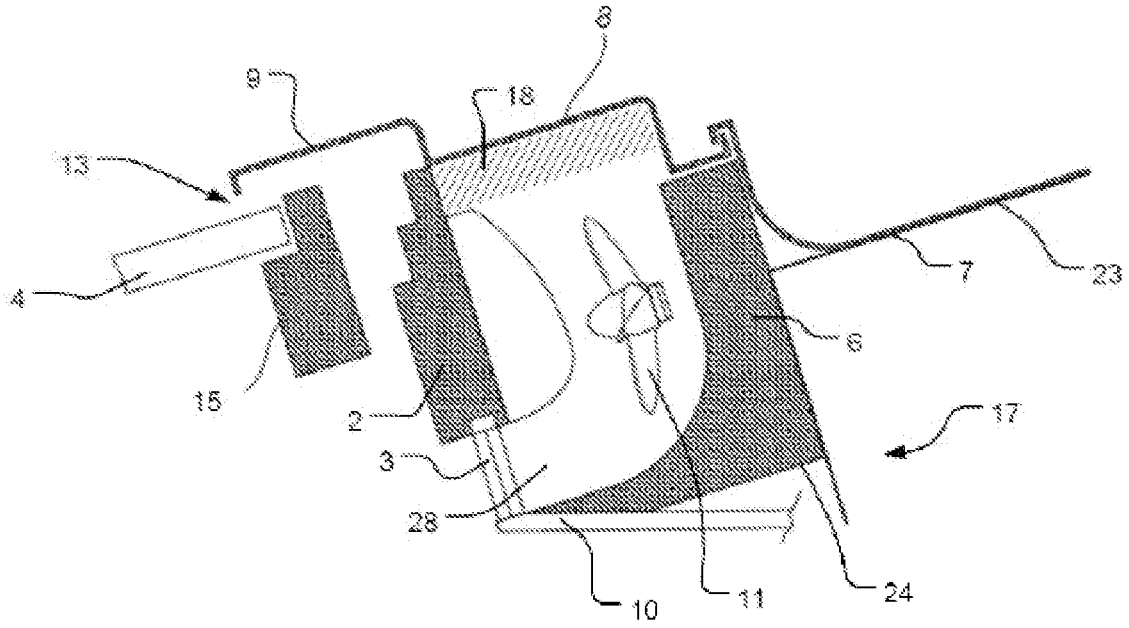
FIG. 7*a* is a cross-section view of a roof window system in an alternative embodiment.

FIG. 7*a* shows a cross-sectional view of an alternative embodiment of the roof window system, wherein the dimensions of the housing 6 are chosen such that the length of the housing 6 is parallel to the length of the frame member 2, which the ventilation unit 5 is adjacent to. The length of the housing 6 does not exceed the length of the frame member 2. The height of the housing 6 is parallel to the height of the frame member 2 which the ventilation unit 5 is adjacent to and does not exceed the height of the frame member 2.

The person skilled in the art realizes that the present invention by no means is limited to the preferred embodiments described above. On the contrary, many modifications and variations are possible within the scope of the appended claims.

LIST OF REFERENCE NUMERALS 1 roof window system
2 frame
2*a* top frame member
2*b* side frame member
2*c* side frame member
2*d* inner side of top frame member
2*e* outer side of top frame member
2*f* interior side of top frame member
3 ventilation panel
4 pane
5 ventilation unit
6 housing
7 flashing member
8 top case of housing
9 top frame covering
10 lining panel
11 ventilator
12 groove
13 roof window
14 interior of building
15 sash
16 frame opening
17 ventilation assembly
18 exterior air grating
19 air grating
20 intended air flow direction
21 exterior direction
22 interior direction
23 roof structure
24 lower side of ventilation unit
25 insulation
26 longitudinal channel
27 drainage channel
28 ventilation passage
29 solar cells
30 air purifying filter
A1 inner frame plane
A2 outer frame plane

The invention claimed is:

1. A roof window system configured for being mounted in an opening in a roof structure of a building, said roof window system including a ventilation unit configured for being mounted adjacent to a roof window and adapted for providing ventilation of an interior of the building in which the roof window is mounted, where said roof window comprises at least one frame defining a frame plane and including a pane mounted in said at least one frame, the at least one frame comprising a top frame member intended for being located highest in a mounted state when seen in a direction of inclination of the roof structure, a bottom frame member opposite the top frame member, and two side frame members extending between the top frame member and the bottom frame member, said top frame member, said bottom frame member and said two side frame members together form a window structure delimiting a frame opening and each having an interior side intended for facing an interior in the mounted state, an exterior side intended for facing an exterior, an inner side facing the frame opening and an outer side facing away from the frame opening, where the ventilation unit is configured for being arranged primarily adjacent to the outer side of a corresponding frame member, and the ventilation unit comprises a frame facing side configured for being arranged adjacent to or at the interior side of said corresponding frame member and the roof window system further comprising a ventilation panel allowing air passage from one side of the ventilation panel to another side of the ventilation panel, thereby defining an intended air flow direction, said ventilation panel being configured for facing the interior of the building, wherein the ventilation unit and/or ventilation panel when installed are oriented relative to the roof window so that the roof window system includes at least one of the following:

(i) the ventilation unit ventilates the interior of the building without air passing through the at least one frame, (ii) a first plane extending from the exterior to the interior and passing through a center of said ventilation unit does not pass through the frame opening, the first plane extending substantially perpendicular to the direction of inclination of the roof structure, (iii) the ventilation panel extends inwardly from an innermost surface of the interior side of the corresponding frame member, wherein the interior side of the corresponding frame member forms a bottom of the corresponding frame member, (iv) at least a portion of the ventilation panel is positioned at or below an innermost surface of the interior side of the corresponding frame member; and, (v) at least a portion of the ventilation unit extends outwardly from an outermost portion of the outer side of the corresponding frame member in a direction parallel to the frame plane such that an exterior air inlet is horizontally offset outwardly from the frame opening.

2. A roof window system according to claim 1, wherein the ventilation panel is configured such that the ventilation panel does not extend below a window frame plane defined by the inner side of the corresponding frame member in a mounted state.

3. A roof window system according to claim 2, wherein the ventilation panel is configured for being accommodated in a groove in the frame adapted for receiving a lining panel and/or the ventilation panel is provided with a groove configured to accommodate a lining panel.

4. A roof window system according to claim 1, wherein the ventilation panel is configured such that the intended air flow direction is extending substantially perpendicular to the frame plane in the mounted state.

5. A roof window system according to claim 4, wherein the ventilation panel is configured for being accommodated in a groove in the frame adapted for receiving a lining panel and/or the ventilation panel is provided with a groove configured to accommodate a lining panel.

6. A roof window system according to claim 1, wherein the ventilation unit is configured to be arranged at the top frame member.

7. A roof window system according to claim 6, wherein the ventilation panel is configured for being accommodated in a groove in the frame adapted for receiving a lining panel and/or the ventilation panel is provided with a groove configured to accommodate a lining panel.

8. A roof window system according to claim 1, wherein the ventilation panel is configured for being accommodated in a groove in the frame adapted for receiving a lining panel and/or the ventilation panel is provided with a groove configured to accommodate a lining panel.

9. A roof window system according to claim 1, further comprising a lining panel, wherein the ventilation panel is integrated in the lining panel.

10. A roof window system according to claim 1, wherein the ventilation panel comprises a grating and/or a closure.

11. A roof window system according to claim 1 comprising a ventilation assembly comprising the ventilation unit that is configured for being arranged adjacent to the outer side of the corresponding frame member and a housing, said housing accommodates the ventilation unit.

12. A roof window system according to claim 11, wherein dimensions of the housing are chosen such that a length of the housing is parallel to a length of the corresponding frame member which the ventilation unit is adjacent to and does not exceed the length of the corresponding frame member, and a height of the housing is parallel to a height of the corresponding frame member which the ventilation unit is adjacent to and does not exceed the height of the corresponding frame member.

13. A roof window system according to claim 11, wherein the housing comprises a solar cell mounted on an exterior side of the housing for supplying electricity to the ventilation unit.

14. A roof window system according to claim 1, further comprising a sash, comprising a top member, bottom member and two side members defining a sash plane, wherein the ventilation unit is configured for being mounted such that the ventilation unit, the corresponding frame member adjacent to which the ventilation unit is mounted and a corresponding sash member are located substantially in continuation of each other when seen in a direction of the frame plane in the mounted state.

15. A roof window system according to claim 1, wherein a ventilation assembly further comprising an input and exhaust of air and/or a ventilator and/or an air purifying filter.

16. A roof structure including a roof window system, said roof window system including a ventilation unit configured for being mounted adjacent to a roof window and adapted for providing ventilation of an interior of the building in which the roof window is mounted, where said roof window comprises at least one frame defining a frame plane and including a pane mounted in said at least one frame, the at least one frame comprising a top frame member located highest when seen in a direction of inclination of the roof structure, a bottom frame member opposite the top frame member, and two side frame members extending between the top frame member and the bottom frame member, said top frame member, said bottom frame member and said two side frame members together form a window structure delimiting a frame opening and each having an interior side facing the interior, an exterior side facing the exterior, an inner side facing the frame opening and an outer side facing away from the frame opening, where the ventilation unit is arranged at the outer side of a corresponding frame member, wherein the ventilation unit comprises a lower side configured for being arranged adjacent to or at the interior side of said corresponding frame member, the roof window system further comprising a ventilation panel facing the interior of the building, wherein the ventilation unit and/or ventilation panel when installed are oriented relative to the roof window so that the roof window system includes at least one of the following:

(i) the ventilation unit ventilates the interior of the building without air passing through the at least one frame, (ii) a first plane extending from the exterior to the interior and passing through a center of said ventilation unit does not pass through the frame opening, the first plane extending substantially perpendicular to the direction of inclination of the roof structure, (iii) the ventilation panel extends inwardly from an innermost surface of the interior side of the corresponding frame member, wherein the interior side of the corresponding frame member forms a bottom of the corresponding frame member, (iv) at least a portion of the ventilation panel is positioned at or below an innermost surface of the interior side of the corresponding frame member; and, (v) at least a portion of the ventilation unit extends outwardly from an outermost portion of the outer side of the corresponding frame member in a direction parallel to the frame plane such that an exterior air inlet is horizontally offset outwardly from the frame opening.

17. A method of providing ventilation for a building using a ventilation unit configured for being mounted adjacent to a roof window, where said roof window comprises at least one frame defining a frame plane and a pane mounted in said at least one frame, the at least one frame comprising a top frame member intended for being located highest in a mounted state when seen in a direction of inclination of a roof structure, a bottom frame member opposite the top frame member, and two side frame members extending between the top frame member and the bottom frame member, said top frame member, said bottom frame member and said two side frame members together form a window structure delimiting a frame opening and each having an interior side intended for facing an interior in the mounted state, an exterior side intended for facing an exterior, an inner side facing the frame opening and an outer side facing away from the frame opening, said method comprising the steps of:

arranging the ventilation unit adjacent to the outer side of a corresponding frame member, said ventilation unit being adapted for providing ventilation of an interior of the building, arranging a ventilation panel so that the ventilation panel it faces the interior of the building, orienting the ventilation unit and/or ventilation panel relative to the roof window so that at least one of the following exists:

(i) the ventilation unit ventilates the interior of the building without air passing through the at least one frame, (ii) a first plane extending from the exterior to the interior and passing through a center of said ventilation unit does not pass through the frame opening, the first plane extending substantially perpendicular to the direction of inclination of the roof structure, (iii) the ventilation panel extends inwardly from an innermost surface of the interior side of the corresponding frame member, wherein the interior side of the corresponding frame member forms a bottom of the corresponding frame member, (iv) at least a portion of the ventilation panel is positioned at or below an innermost surface of the interior side of the corresponding frame member; and, (v) at least a portion of the ventilation unit extends outwardly from an outermost portion of the outer side of the corresponding frame member in a direction parallel to the frame plane such that an exterior air inlet is horizontally offset outwardly from the frame opening, and passing air through the ventilation panel from one side of the ventilation panel to another side of the ventilation panel in an intended air flow direction using the ventilation unit.

* * * * *